US006655179B2

(12) United States Patent
Kobayashi et al.

(10) Patent No.: US 6,655,179 B2
(45) Date of Patent: Dec. 2, 2003

(54) AUTOMOTIVE DOOR LOCK ASSEMBLY

(75) Inventors: Fumio Kobayashi, Kanagawa (JP); Ryoji Shimura, Yokohama (JP)

(73) Assignee: Ohi Seisakusho Co., Ltd., Kanagawa (JP)

( * ) Notice: Subject to any disclaimer, the term of this patent is extended or adjusted under 35 U.S.C. 154(b) by 0 days.

(21) Appl. No.: 09/983,820

(22) Filed: Oct. 26, 2001

(65) Prior Publication Data

US 2002/0050156 A1 May 2, 2002

(30) Foreign Application Priority Data

Oct. 26, 2000 (JP) ..... 2000-327522

(51) Int. Cl.[7] ..... E05B 65/12; E05B 65/30; E05B 49/00

(52) U.S. Cl. ..... 70/237; 70/264; 70/278.7; 70/279.1

(58) Field of Search ..... 70/264, 237, 279.1, 70/278.7; 292/216, 201, DIG. 23

(56) References Cited

U.S. PATENT DOCUMENTS 4,974,886 A * 12/1990 Kleefeldt et al. ..... 292/201
4,978,154 A * 12/1990 Kleefeldt et al. ..... 292/201
6,079,757 A * 6/2000 Aubry ..... 292/201
6,102,453 A * 8/2000 Cetnar ..... 292/201
6,364,378 B1 * 4/2002 Humbert et al. ..... 292/201

FOREIGN PATENT DOCUMENTS

DE 3717940 A1 * 7/1988
JP 03063368 A * 3/1991
JP 4-20684 1/1992

* cited by examiner

*Primary Examiner*—Anthony Knight
*Assistant Examiner*—Michael J. Kyle
(74) *Attorney, Agent, or Firm*—Sughrue Mion, PLLC

(57) ABSTRACT

A so-called super-lock condition of a door lock is achieved with a simple and compact construction. The door lock includes first and second lock/unlock mechanisms which establish the super-lock condition when assuming lock conditions respectively. The first and second lock/unlock mechanisms are actuated by an electric actuator mounted to the door lock. In a housing of the electric actuator, there are installed first and second electric motors and first and second operation levers. Due to power of the first electric motor, the first operation lever is switched between an unlock position causing the first lock/unlock mechanism to assume the unlock condition and a lock position causing the first lock/unlock mechanism to assume the lock condition, and due to power of the second electric motor, the second operation lever is switched between an unlock position causing the second lock/unlock mechanism to assume the unlock condition and a lock position causing the second lock/unlock mechanism to assume the lock condition.

10 Claims, 9 Drawing Sheets

AUTOMOTIVE DOOR LOCK ASSEMBLY

BACKGROUND OF THE INVENTION

1. Field of the Invention

The present invention relates in general to automotive door lock assemblies and more particularly to the automotive door lock assemblies of a thief-proof type.

2. Description of the Prior Art

In known automotive door lock assemblies hitherto used, there is a type which comprises a key cylinder which is mounted on the door to face the outside of the same, a lock/unlock mechanism which can switch between a lock condition wherein manipulation of both outside and inside handles of the door for opening the door is inoperative and an unlock condition wherein the manipulation of them is operative and an override mechanism which can make the manipulation of the inside handle operative even when the lock/unlock mechanism is in the lock condition.

However, due to its inherent construction, the door lock assemblies of this type have failed to exhibit a satisfied thief-proof function. That is, even when the door is locked with the lock/unlock mechanism kept in the lock condition, manipulation of the inside handle by a picking tool or the like inserting through a small clearance for example between a door window pane and the door body would induce switching of the lock/unlock mechanism to the unlock condition thereby causing illegal opening of the door.

One of the automotive door lock assemblies that overcomes the above-mentioned drawback is disclosed in Japanese Patent First Provisional Publication 4-20684. That is, in the door lock assembly of this publication, there are further employed a safety mechanism which can make the override mechanism inoperative in a certain condition and an electric actuator which actuates the safety mechanism with an electric power. That is, by operating the safety mechanism by the electric actuator, the manipulation of the inside handle becomes inoperative in the certain condition.

However, even the door lock assembly of this publication has failed to provide users with a satisfaction. That is, in this door lock assembly, the two electric motors for respectively actuating the safety mechanism and the lock/unlock mechanism are separately arranged in the assembly, and thus the entire construction of the door lock assembly is bulky.

SUMMARY OF THE INVENTION

It is therefore an object of the present invention to provide a thief-proof automotive door lock assembly which is simple in construction and compact in size.

According to the present invention, there is provided a thief-proof automotive door lock assembly which generally comprises a door lock which includes first and second lock/unlock mechanisms and an electric actuator which includes first and second electric motors and first and second operation levers, wherein the first and second lock/unlock mechanisms can be brought to respective lock conditions for providing a so-called "super-lock condition" thereby to improve the thief-proof function of the door lock assembly.

According to the present invention, there is provided an automotive door lock assembly for use with an automotive door having outside and inside handles mounted thereon. The assembly comprises a door lock including a first lock/unlock mechanism which switches between an unlock condition wherein manipulation of the outside handle is made operative and a lock condition wherein manipulation of the outside handle is made inoperative and a second lock/unlock mechanism which switches between an unlock condition wherein manipulation of the inside handle is made operative and a lock condition wherein manipulation of the inside handle is made inoperative; and an electric actuator mounted to the door lock for actuating the same. The electric actuator includes a housing secured to a base member of the door lock; first and second electric motors installed in the housing; a first operation lever straightly movably held by the housing, the first operation lever being actuated by the first electric motor to switch between an unlock position to cause the first lock/unlock mechanism to assume the unlock condition and a lock position to cause the first lock/unlock mechanism to assume the lock condition; and a second operation lever pivotally held by the housing, the second operation lever being actuated by the second electric motor to switch between an unlock position to cause the second lock/unlock mechanism to assume the unlock condition and a lock position to cause the second lock/unlock mechanism to assume the lock condition.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
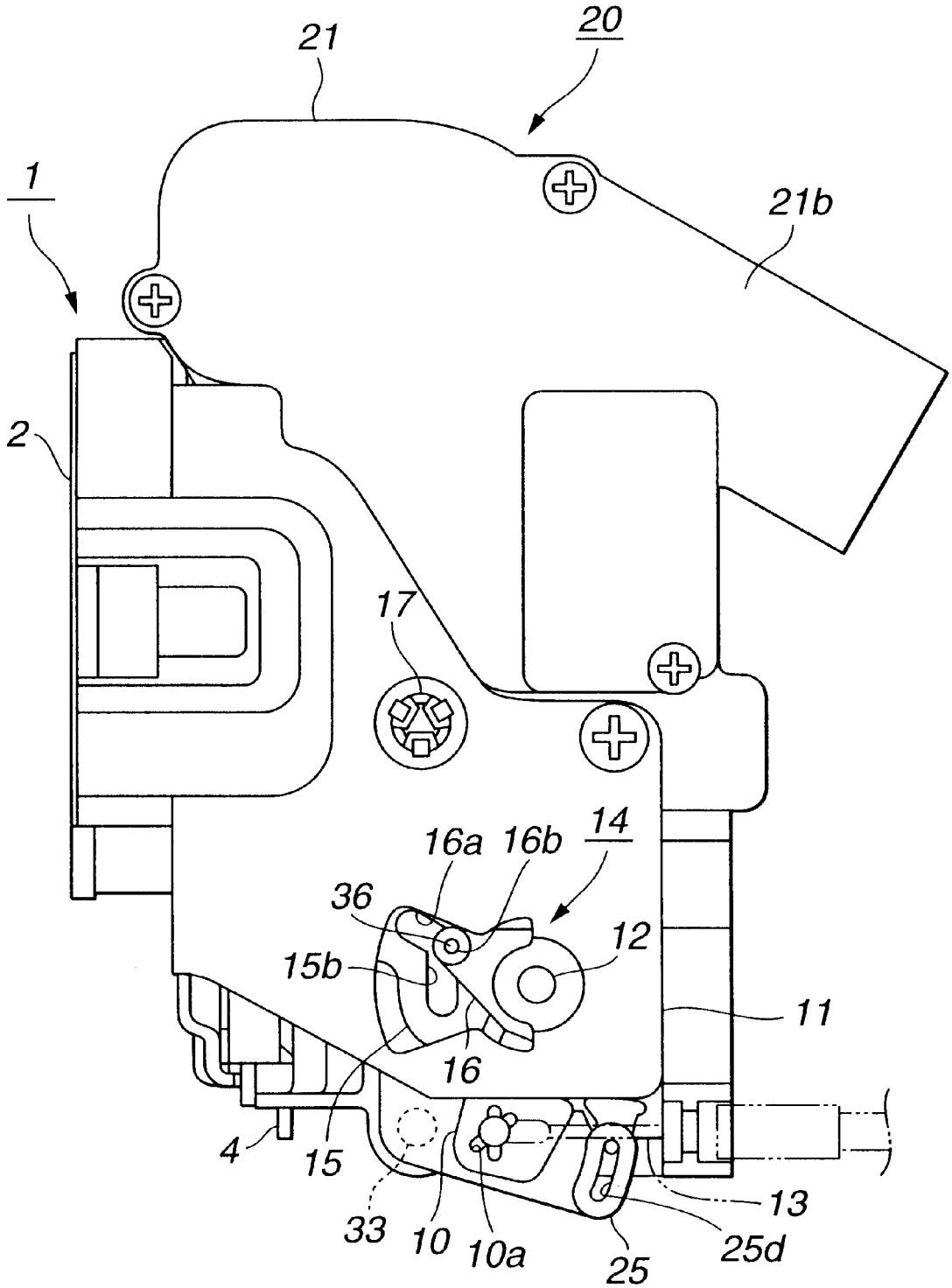
FIG. 1 is a side view of a thief-proof automotive door lock assembly according to the present invention.

In the following, the present invention will be described in detail with reference to the accompanying drawings. For ease of understanding, various directional terms, such as, right, left, upper, lower, rightward and the like are used in the description. However, such terms are to be understood with respect to only the drawing or drawings on which the corresponding part or portion is illustrated.

Figure 2:
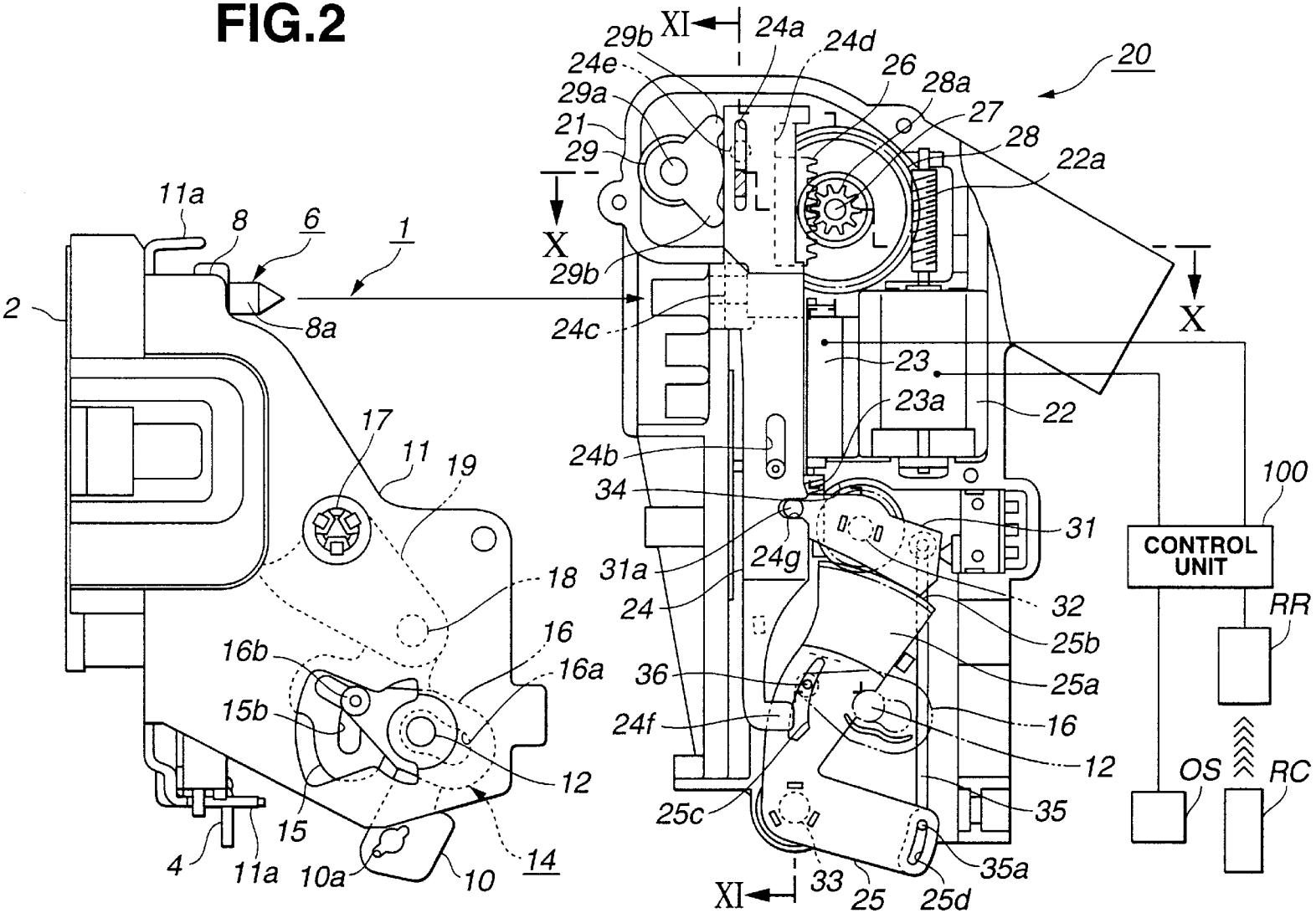
FIG. 2 is a side view of the thief-proof automotive door lock assembly of the invention in a condition wherein a door lock and an electric actuator are separated from each other.

Referring to the drawings, particularly FIGS. 1 and 2, there is shown a thief-proof automotive door lock assembly according to the present invention.

In these drawings, denoted by numerals 1 and 20 are a door lock and an electric actuator which are combined to constitute the thief-proof automotive door lock assembly of the present invention.

The door lock 1 is fixed to a free end of an automotive pivotal door by means of bolts. Although not shown, a striker is fixed to a vehicle body, against which a latch plate of the door lock 1 is engageable.

The door lock 1 comprises a body 2, the latch plate pivotally held in the body 2 to engage with the striker and a lock pawl pivotally held in the body 2 to restrain or lock the latch plate in the engaged position.

Figure 3:
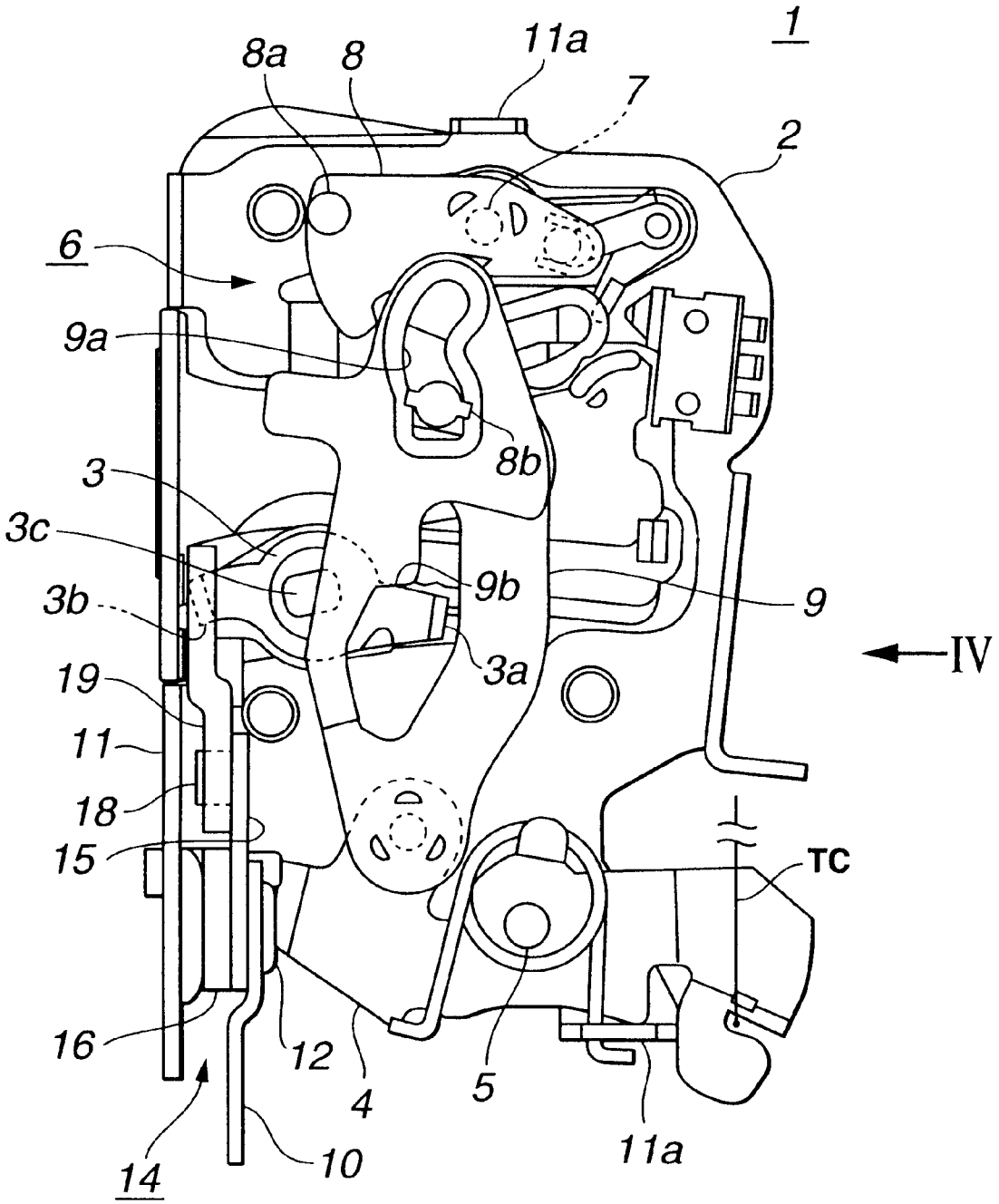
FIG. 3 is a front view of the door lock.

As is seen from FIG. 3 which shows a front view of the door lock 1, an open lever 3 is connected to the lock pawl through a shaft 3*c* to pivot together like a single unit. That is, when the open lever 3 is pivoted in a clockwise direction in the drawing, that is, in an opening direction, the lock pawl releases or unlocks the latch plate to permit opening of the door.

In FIG. 3, denoted by numeral 4 is an outside lever which is pivotally connected to the front surface of the body 2 by means of a shaft 5. One end of the outside lever 4 is connected through a transmission cable TC to an outside handle (not shown) mounted on an outside surface of the door. That is, when the outside handle is manipulated for the purpose of opening the door, the transmission cable TC pulls the outside lever 4 to pivot the same in a counterclockwise direction in the drawing, that is, in an opening direction.

In FIG. 3, denoted by numeral 6 is a first lock/unlock mechanism which can switch the door lock 1 from a lock condition to an unlock condition in response to manipulation of the outside handle of the door. The first lock/unlock mechanism 6 generally comprises a lock/unlock lever 8 which is pivotally connected through a shaft 7 to the front surface of the body 2 and has a left end 8*a* projected, and a sub-lever 9 which has a lower portion pivotally connected to the outside lever 4 and has an upper portion formed with an arcuate slot 9*a*. The arcuate slot 9*a* is slidably engaged with a projection 8*b* provided on a lower end of the lock/unlock lever 8.

When the outside lever 4 is pivoted in the opening direction, that is, in a counterclockwise direction in FIG. 3, the sub-lever 9 is shifted downward. The sub-lever 9 is formed at a generally middle portion thereof with a canceling portion 9*b* which is engageable with a first engaging portion 3*a* of the open lever 3 upon the downward shifting thereof.

When the first lock/unlock mechanism 6 is in its lock condition, the lock/unlock lever 8 and the sub-lever 9 assume respective lock positions as shown in FIG. 3. Under this lock condition of the mechanism 6, even when the sub-lever 9 is shifted downward due to manipulation of the outside handle of the door through the outside lever 4, the canceling portion 9*b* of the sub-lever 9 does not engage with the first engaging portion 3*a* of the open lever 3 thereby failing to open the door.

While, when the first lock/unlock mechanism 6 is turned to its unlock condition, the lock/unlock lever 8 is pivoted counterclockwise by a given angle to assume an unlock position and the sub-lever 9 is pivoted clockwise by a given angle to assume an unlock position. Under this unlock condition of the mechanism 6, when the sub-lever 9 is shifted downward due to manipulation of the outside handle of the door, the canceling portion 9*b* of the sub-lever 9 is brought into abutment with the first engaging portion 3*a* of the open lever 3 thereby turning the open lever 3 in the opening direction. Thus, the door is permitted to open.

Figure 4:
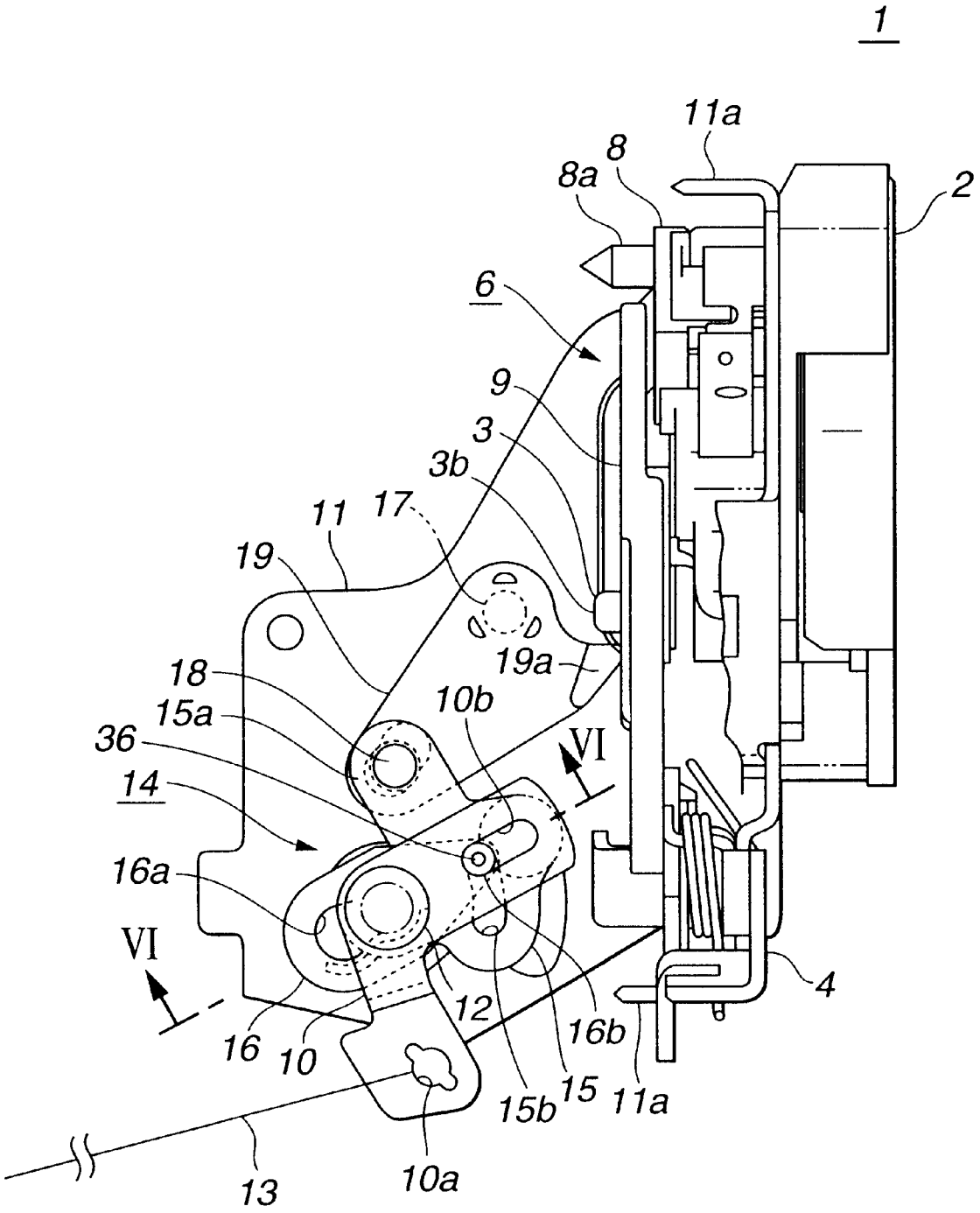
FIG. 4 is a view taken from the direction of the arrow "IV" of FIG. 3.

FIG. 4 shows a side view of the door lock 1. In this drawing, denoted by numeral 11 is a base plate secured to body 2. It is to be noted that when the door lock 1 is properly mounted on the free end of the pivotal door, the base plate 11 extends in parallel with a major surface of the door. A generally L-shaped inside lever 10 is pivotally connected to the base plate 11 through a shaft 12. The inside lever 10 is formed at a lower portion with a connecting opening 10*a*. As is seen from FIGS. 4 and 1, to the connecting opening 10*a*, there is connected a connecting cable 13 which extends from an inside handle (not shown) mounted on an inside surface of the door. When the inside handle is manipulated for the purpose of opening the door, the inside lever 10 is pivoted in an opening direction, that is, in a clockwise direction in FIG. 4 and in a counterclockwise direction in FIG. 1. As is seen from FIG. 4, a rear portion of the inside lever 10 is formed with an elongate slot 10*b*.

In FIG. 4, denoted by numeral 14 is a second lock/unlock mechanism which can switch the door lock 1 from the lock condition to the unlock condition in response to manipulation of the inside handle of the door.

The second lock/unlock mechanism 14 comprises an intermediate lever 15 which is pivotally connected through the shaft 12 to the base plate 11, a switch lever 16 which has an elongate opening 16*a* slidably engaged with the shaft 12 and thus is linearly movably relative to the shaft 12, and an override lever 19 which is pivotally connected through a shaft 17 to the base plate 11 and has a lower end portion pivotally connected through a connecting shaft 18 to an arm 15*a* of the intermediate lever 15.

The intermediate lever 15 is formed with a generally L-shaped groove 15*b* mated with the elongate slot 10*b* of the inside lever 10.

Figure 5:
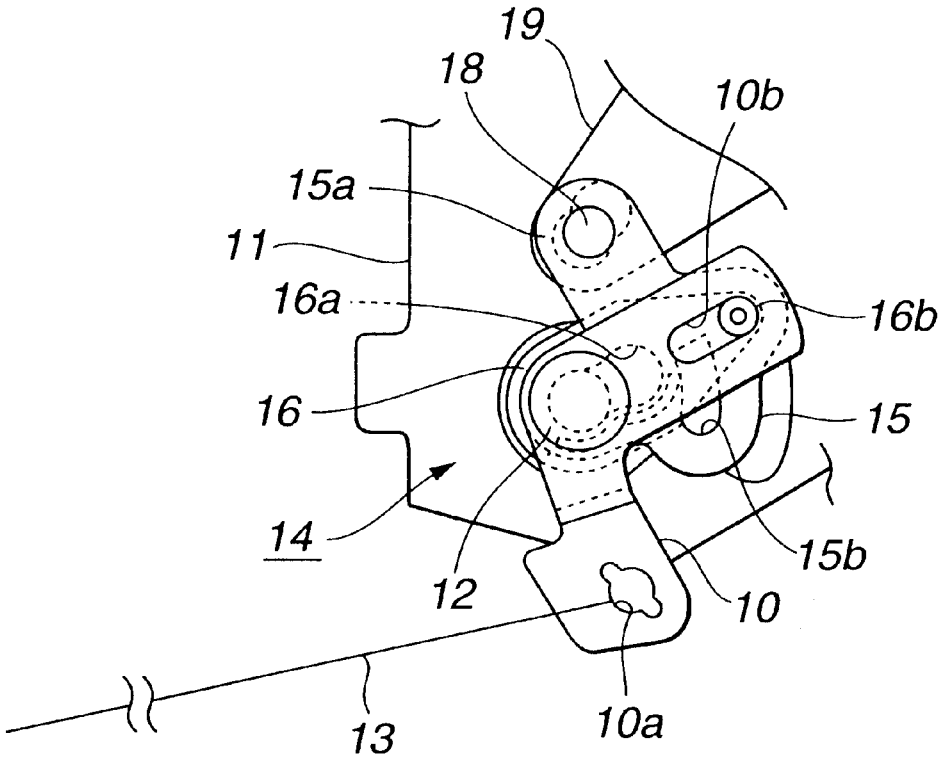
FIG. 5 is a partial view of FIG. 4, but showing a condition wherein a second lock/unlock mechanism of the door lock is in an unlock condition.

The switch lever 16 is provided with a projection 16*b* which is slidably engaged with both the L-shaped groove 15*b* of the intermediate lever 15 and the elongate slot 10*b* of the inside lever 10. The switch lever 16 is movable between a lock position as shown in FIG. 1 wherein the projection 16*b* is located at a corner of the L-shaped groove 15*b* to induce the lock condition of the second lock/unlock mechanism 14 and an unlock position as shown in FIG. 5 wherein the projection 16*b* is located at a rear end of the L-shaped groove 15*b* to induce the unlock condition of the mechanism 14. That is, when the switch lever 16 is in the lock position as shown in FIG. 1, the pivoting of the inside lever 10 in the opening direction is not transmitted to the intermediate lever 15, while, when the switch lever 16 is in the unlock position as shown in FIG. 5, the switch lever 16 can pivot together with the inside lever 10 in the opening direction, and thus such opening operation is transmitted to the intermediate lever 15 through the projection 16*b* of the switch lever 16.

In response to the pivoting of the intermediate lever 15 in the opening direction, the override lever 19 is pivoted in an opening direction (viz., in a counterclockwise direction in FIG. 4) through the connecting shaft 18. Due to this pivoting, a canceling portion 19*a* provided on an end portion of the override lever 19 is brought into engagement with a second engaging portion 3*b* formed on the open lever 3 thereby to pivot the open lever 3 in the opening direction.

When the second lock/unlock mechanism 14 is in the unlock condition, manipulation of the inside handle of the door for the purpose of opening the door can induce opening of the door. That is, under such condition, the manipulation of the inside handle induces an integral pivoting of the inside lever 10 and the switch lever 16 in the opening direction bringing about engagement of the projection 16*b* with the L-shaped groove 15*b* thereby pivoting the intermediate lever 15 in the opening direction, and thus the open lever 3 is pivoted in the opening direction through the override lever 19.

While, when the second lock/unlock mechanism 14 is in the lock condition, the manipulation of the inside handle of the door can not induce opening of the door. That is, under such condition, even when the inside lever 10 is pivoted in the opening direction due to manipulation of the inside handle of the door, the projection 16*b* of the switch lever 16 fails to strike against the L-shaped groove 15*b*, and thus the movement of the inside lever 10 is not transmitted to the intermediate lever 15 and thus to the override lever 19. Accordingly, the door can not be opened.

Referring back to FIG. 1, the electric actuator 20 works to actuate the door lock 1 with an electric power. The electric actuator 20 is mounted to the door lock 1 in such a manner as will be described in the following.

As is seen from FIGS. 1 and 2, the electric actuator 20 comprises a plastic housing 21 which is secured to the base plate 11.

As is seen from FIG. 2, within the housing 21, there are installed a first electric motor 22, a second electric motor 23, a first operation lever 24 and a second operation lever 25. That is, upon operation of a portable remote controller "RC" or an operation switch "OS" mounted in the vicinity of a driver's seat, the first motor 22 is energized to run in a given direction to operate the first lock/unlock mechanism 6. Upon operation of the remote controller "RC", the second motor 23 is energized to run in a given direction to operate the second lock/unlock mechanism 14. Specifically, upon receiving information signals from the remote controller "RC" and the operation switch "OS", a control unit 100 issues instruction signals to the first and second motors 22 and 23 in such a manner as will be described hereinafter.

The control unit 100 generally comprises a CPU (central processing unit), a RAM (random access memory), a ROM (read only memory) and input and output interfaces.

The first operation lever 24 is connected to the first lock/unlock mechanism 6, and the second operation lever 25 is connected to the second lock/unlock mechanism 14.

As shown in FIG. 2, the first operation lever 24 has two elongate slots 24*a* and 24*b* slidably engaged with projections (no numerals) provided by the housing 21, so that the first operation lever 24 is vertically movably held by the housing 21. The first operation lever 24 is formed with an opening 24*c* to which the projected end 8*a* of the lock/unlock lever 8 of the above-mentioned door lock 1 is engaged. With this, the first lock/unlock mechanism 6 of the door lock 1 is engaged with the first operation lever 24. The first operation lever 24 is further formed at an upper portion with a vertically extending groove 24*d* in which a rack 26 is slidably received.

Figure 8:
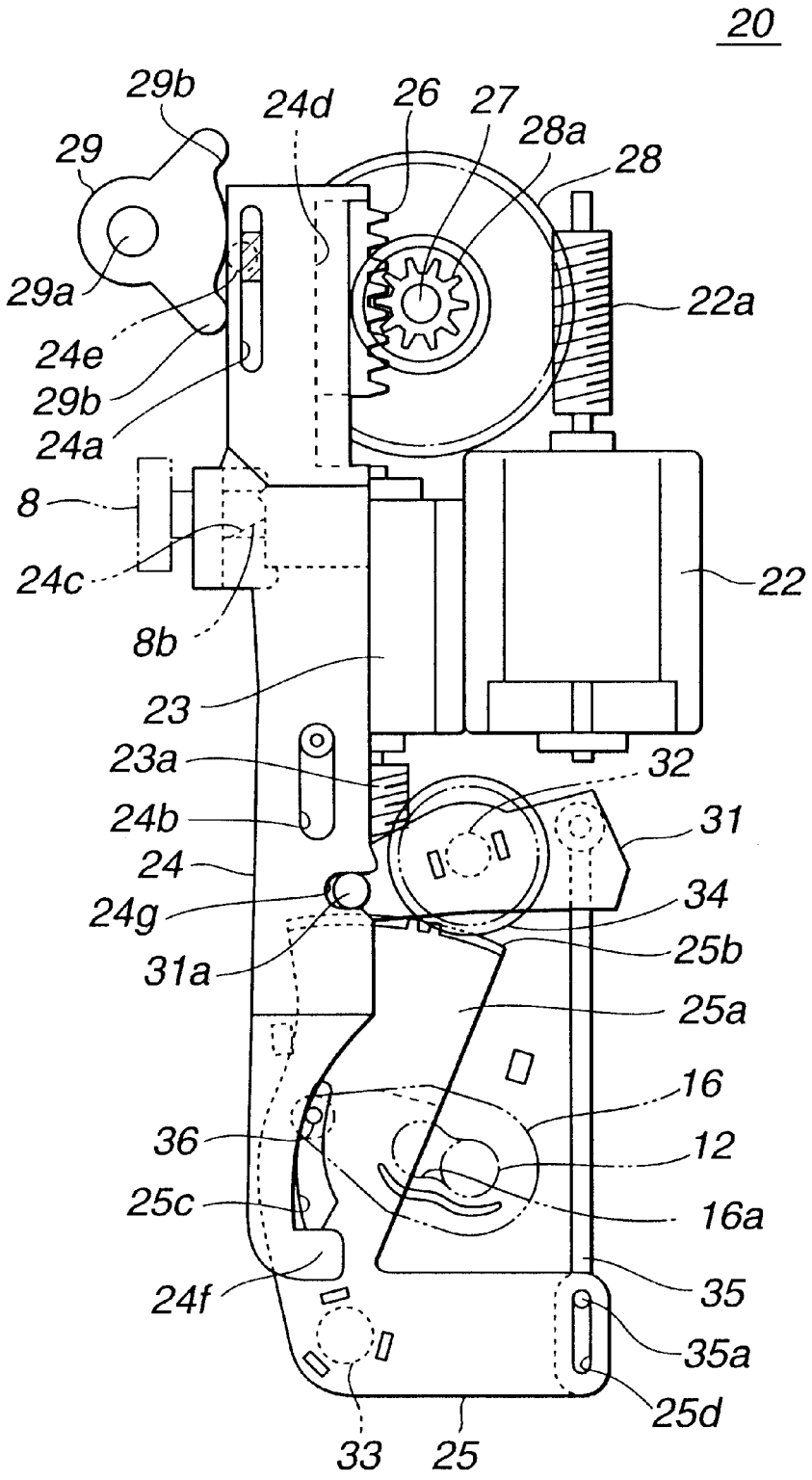
FIG. 8 is a side view of the electric actuator in one condition.

Due to energization of the first motor 22, the first operation lever 24 is moved between a lock position as shown in FIG. 2 wherein the first lock/unlock mechanism 6 assumes the lock condition and an unlock position as shown in FIG. 8 wherein the first lock/unlock mechanism 6 assumes the unlock condition. That is, the actuating motion produced by the first motor 22 is transmitted to the first operation lever 24 through a train including a worm 22*a* which is mounted on an output shaft of the motor 22, a worm wheel 28 which is pivotally connected to the housing 21 through a shaft 27 and meshed with the worm 22*a* and the rack 26 which is meshed with a pinion 28*a* concentrically mounted on the worm wheel 28.

The first operation lever 24 is formed at an upper portion thereof with a projection 24*e* and a lower end thereof with a bent part 24*f* that is directed rightward in FIG. 2.

Figure 6:
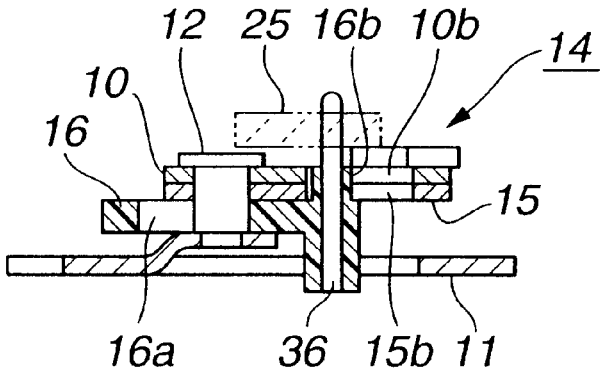
FIG. 6 is a sectional view taken along the line "VI—VI" of FIG. 4.
Figure 9:
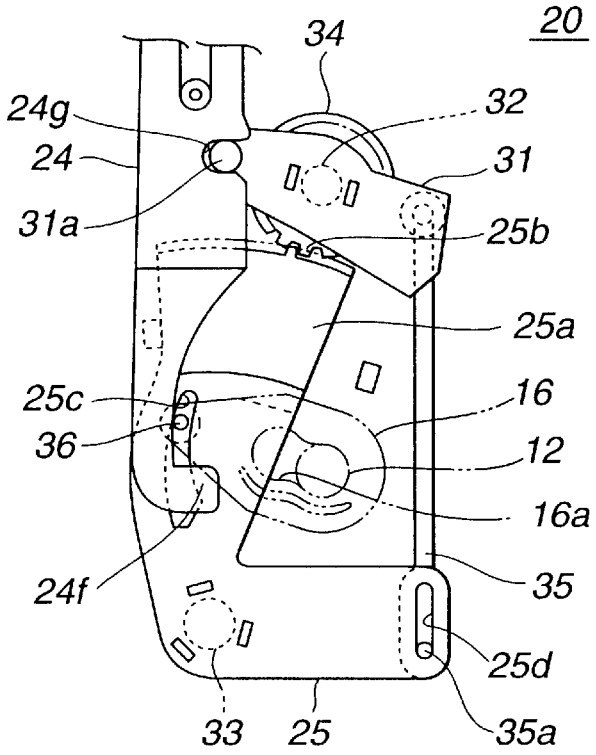
FIG. 9 is a partial view of FIG. 8, but showing a different condition.

When, as is seen from FIG. 9, the first operation lever 24 is in the lock position and the switch lever 16 is in the unlock position, pivoting the switch lever 16 in the opening direction causes a pin 36 held by the projection 16*b* of the switch lever 16 to become engaged with the bent part 24*f* of the lever 24 thereby to force the first operation lever 24 to move from the lock position to the unlock position. With this, the first lock/unlock mechanism 6 is brought to the unlock condition. FIG. 6 shows the detail of the pin 36 held by the projection 16*b* of the switch lever 16.

Referring back to FIG. 2, between the groove 24*d* of the first operation lever 24 and the rack 26, there is defined a clearance for play therebetween, which corresponds to an operation stroke of the first operation lever 24 between the lock and unlock positions of the lever 24. Although not shown in the drawings, the rack 26 and the worm wheel 28 are biased toward their neutral positions by a spring. With this spring, the rack 26 and the worm wheel 28 are suppressed from making reversed rotation even when the first operation lever 24 is moved to the lock or unlock position due to turning of a key cylinder (not shown) mounted on the outside surface of the door.

Denoted by numeral 29 is a key lever which is pivotally connected to a supporting portion 21*a* (see FIGS. 6 and 10) of the housing 21 through a shaft 29*a* which extends to the outside of the door. The key lever 29 is formed with upper and lower arms 29*b* and 29*b* which are engageable with the projection 24*e* of the first operation lever 24.

Figure 10:
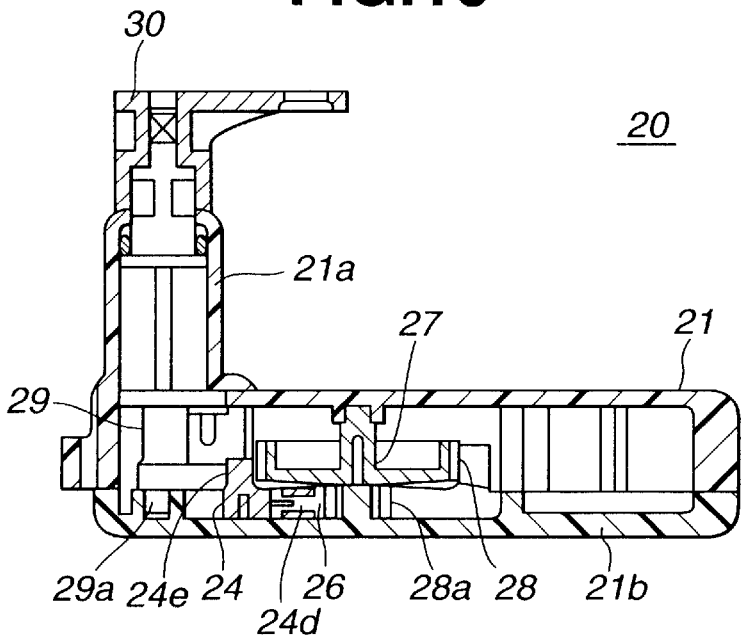
FIG. 10 is a sectional view taken along the line "X—X" of FIG. 2.

As is seen from FIG. 10, to an end of the key lever 29 that projects outside of the door from the supporting portion 21*a*, there is connected a key connection lever 30 which is connected to the key cylinder through a bar or the like. The key connection lever 30 and the key lever 29 are pivoted together like a single unit.

Due to manipulation of the key cylinder by a given key, the key lever 29 is pivoted clockwise and counterclockwise in FIGS. 2 and 8 through the key connection lever 30. Due to pivoting of the key lever 29, the upper or lower arm 29*b* of the lever 29 is brought into abutment with the projection 24*e* of the first operation lever 24 thereby to move the lever 24 to the lock position or unlock position.

In FIG. 2, denoted by numeral 31 is a transmission lever which is pivotally connected through a shaft 32 to the housing 21. A free end of the transmission lever 31 is provided with a projection 31*a* which is slidably engaged with a recess 24*g* formed in the first operation lever 24. Thus, in response to the movement of the first operation lever 24, the transmission lever 31 is pivoted between a lock position as shown in FIGS. 2 and 9 and an unlock position as shown in FIG. 8.

A worm 23*a* is mounted on an output shaft of the second electric motor 23, which is meshed with a worm wheel 34 which is concentrically connected to the transmission lever 31 through the shaft 32.

The second operation lever 25 is generally L-shaped and pivotally connected through a shaft 33 to a lower portion of the housing 21. An upper arm portion 25*a* of the second operation lever 25 is formed at its upper edge with an arcuate toothed part 25*b* which is meshed with the above-mentioned worm wheel 34 and at a portion between the toothed part 25*b* and the shaft 33 with an arcuate slot 25*c* with which the pin 36 held by the projection 16*b* of the switch lever 16 (see FIG. 4) is slidably engaged.

Due to energization of the second motor 23, the engagement of the pin 36 with the arcuate slot 25*c* causes the second operation lever 25 to pivot clockwise or counterclockwise between a lock position as shown in FIG. 2 wherein the second lock/unlock mechanism 14 assumes the lock condition and an unlock position as shown in FIGS. 8 and 9 wherein the mechanism 14 assumes the unlock condition.

Figure 7:
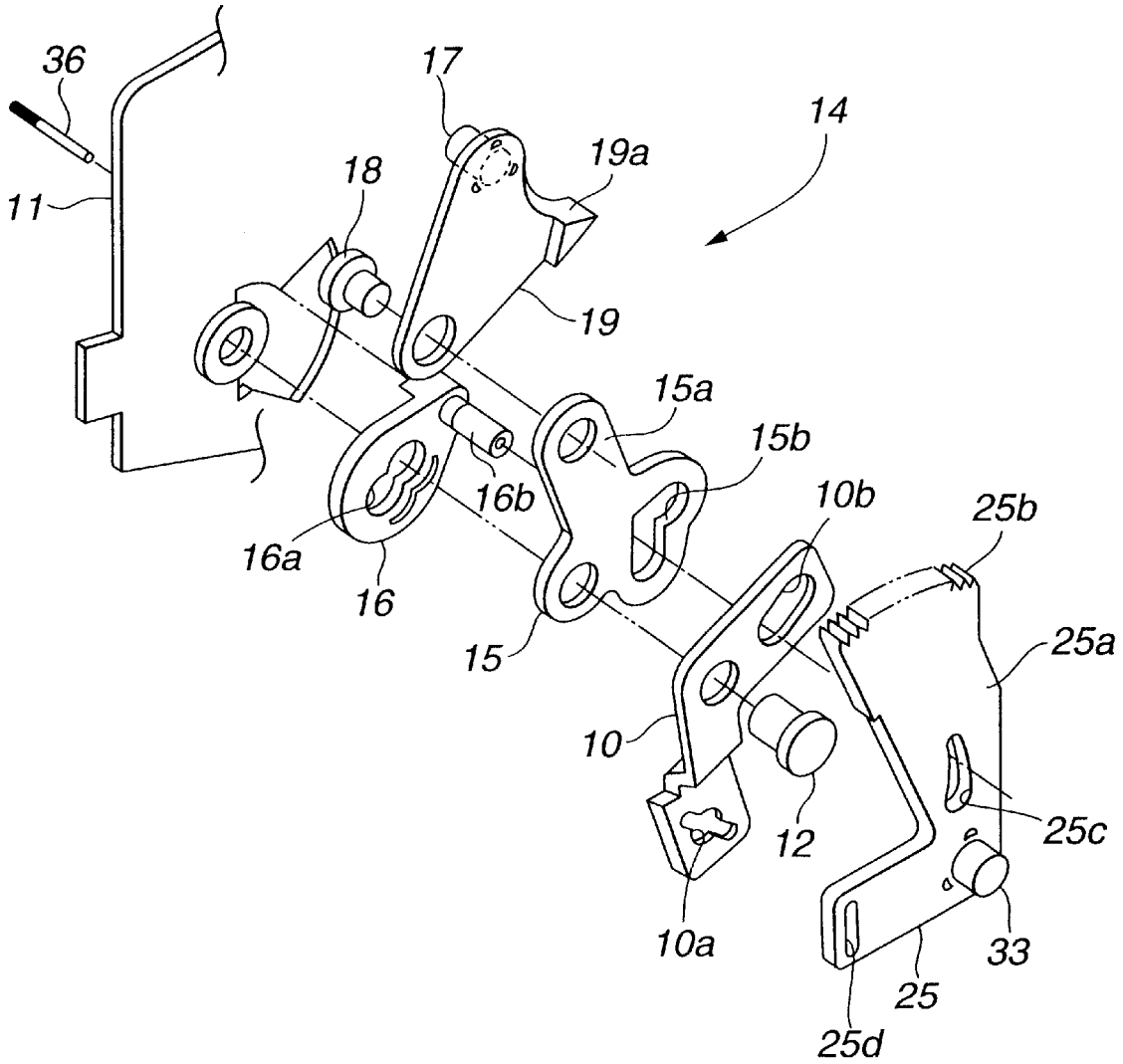
FIG. 7 is an exploded view of the second lock/unlock mechanism of the door lock and a second operation lever of the electric actuator.

As is seen from FIGS. 2 and 7, the actuate slot 25*c* is formed concentric with the shaft 12 through which the L-shaped inside lever 10 is pivotally connected to the base plate 11 of the door lock 1. With this arrangement, the pin 36 does not interrupt the actuate slot 25*c* even when the switch lever 16 is pivoted in the opening direction.

Referring back to FIG. 2, denoted by numeral 35 is a connecting bar which has an upper end pivotally connected to the transmission lever 31 and has a bent lower end 35*a* slidably engaged with an arcuate slot 25*d* formed in the second operation lever 25. As is seen from the drawing, when the first operation lever 24, the transmission lever 31 and the second operation lever 25 are in the respective lock positions, the connecting bar 35 takes such a position that the bent lower end 35*a* of the bar 35 takes an upper position in the arcuate slot 25*d*.

When, with the door lock assembly assuming the condition as shown in FIG. 2, the first operation lever 24 and the transmission lever 31 are pivoted from the lock positions to the unlock positions due to manipulation of the key cylinder through the key connection lever 30 and the key lever 29, the second operation lever 25 is forced to pivot to the unlock position through the connecting bar 35. With this, the second lock/unlock mechanism 14 is brought to the unlock condition.

Figure 11:
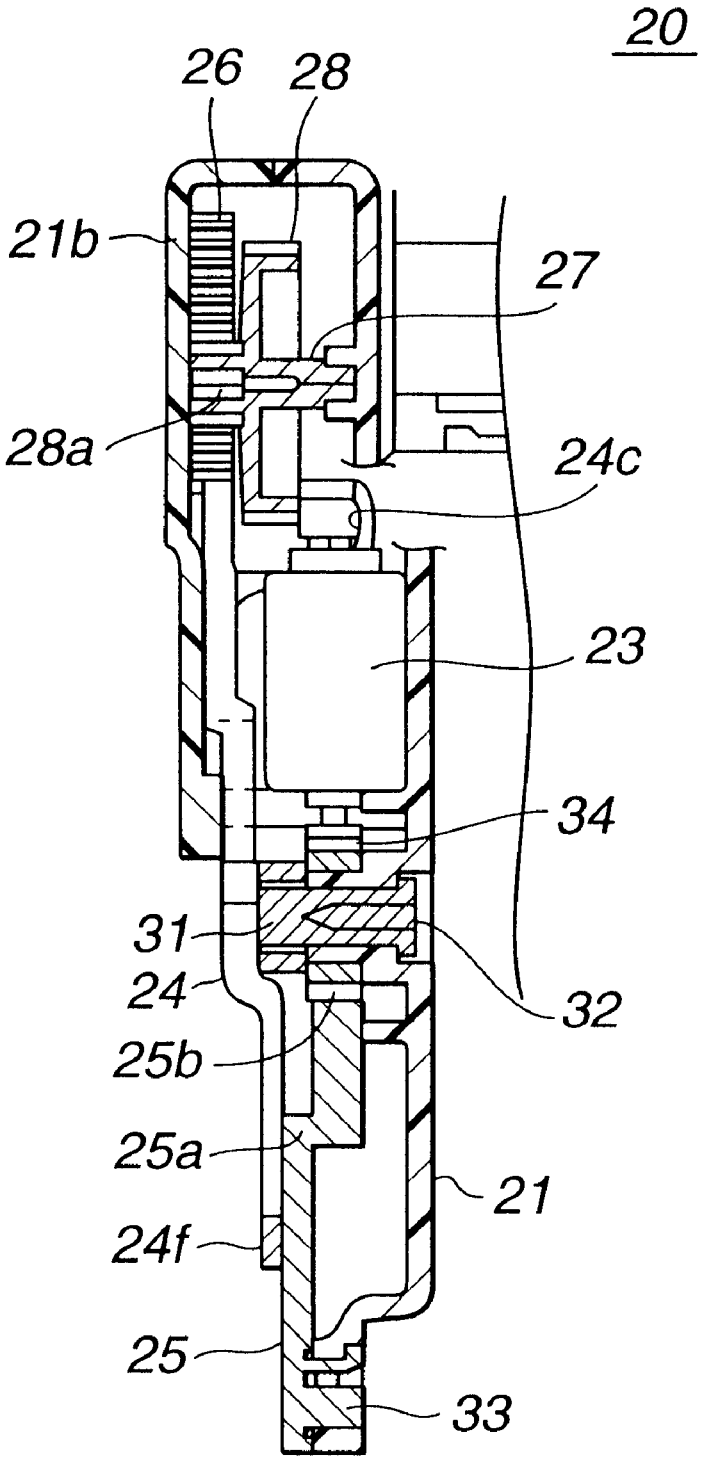
FIG. 11 is a sectional view taken along the line "XI-X1" of FIG. 2.

As is seen from FIG. 2, for mounting the electric actuator 20 to the base plate 11 of the door lock 1, the base plate 11 is formed with a plurality of catching pawls 11*a* by which the housing 21 of the actuator 20 is detachably caught. Upon mounting, the housing 21 covers the elements of the door lock 1. That is, the housing 21 serves as both a means for accommodating the elements of the actuator 20 and a means for providing the door lock 1 with water-proof and thief-proof functions. An upper half of the housing 21 is closed by a cover member 21*b* (see FIGS. 10 and 11).

Upon mounting the housing 21 to the base plate 11, the projected end 8*a* of the lock/unlock lever 8 is brought into engagement with the opening 24*c* of the first operation lever 24 and at the same time the pin 36 held by the projection 16*b* of the switch lever 16 is brought into the arcuate slot 25*c* of the second operation lever 25. With this, the first operation lever 24 becomes connected with the first lock/unlock mechanism 6 and the second operation lever 25 becomes connected with the second lock/unlock mechanism 14.

It is to be noted that on the door to which the automotive door lock assembly of the invention is mounted, there is no lock knob in order to avoid illegal door opening action effected by manipulating the lock knob with a picking tool or the like. Usually, on an automotive door having a door lock assembly mounted therein, there is arranged a lock knob at the inside surface of the door. That is, by manipulating the lock knob by a passenger in the vehicle cabin, a device corresponding to the first lock/unlock mechanism 6 is switched between the lock and unlock conditions.

That is, in the present invention, actuation of the first lock/unlock mechanism 6 is carried out when the key cylinder mounted on the outside surface of the door or the remote controller "RC" is manipulated or when the operation switch "OS" mounted in the vicinity of a driver's seat is manipulated, as has been mentioned hereinabove.

In the following, operation of the thief-proof automotive door lock assembly will be described with reference to the drawings.

For ease of understanding, the explanation will be commenced with respect to a condition wherein the door is closed with the first and second lock/unlock mechanisms 6 and 14 keeping the unlock condition.

Under this condition, the second lock/unlock mechanism 14 shows the condition as shown in FIG. 5, the electric actuator 20 shows the condition as shown in FIG. 8 and the latch plate (which is secured to the open lever 3 (see FIG. 3)) fully latches the striker without being locked by the lock pawl. In this condition, manipulation of the outside handle or inside handle permits or induces opening of the door.

That is, when the outside handle is manipulated for opening the door, the open lever 3 (see FIG. 3) is pivoted in the opening direction through the transmission cable TC, the outside lever 4 and the sub-lever 9, so that the latch plate releases the striker. Upon this, the door is permitted to open when pulled in an opening direction.

While, when, under the above-mentioned closed condition of the door, the inside handle is manipulated for opening the door, the open lever 3 is pivoted also in the opening direction through the inside lever 10, the switch lever 16, the intermediate lever 15 and the override lever 19, so that the latch plate releases the striker. Thus, the door is permitted to open.

When, under the above-mentioned door closed condition, the key cylinder mounted on the door is turned in a locking direction by means of a given key, the first operation lever 24 is forced to move to the lock position through the key connection lever 30 and the key lever 29. Upon this, the first lock/unlock mechanism 6 is brought to its lock condition. During this, the second lock/unlock mechanism 14 is kept in the unlock condition.

When, under the above-mentioned door closed condition, the operation switch "OS" mounted in the vicinity of the driver's seat is turned on, only the first motor 22 is energized to run. Upon this, the first operation lever 24 is moved to the lock position through the worm 22*a*, the worm wheel 28, the pinion 28*a* and the rack 26, so that the first lock/unlock mechanism 6 is brought to the lock condition. During this, the second lock/unlock mechanism 14 is kept in the unlock condition.

While, when, under the above-mentioned door closed condition, the remote controller "RC" is manipulated for the purpose of opening the door, a corresponding information signal is transmitted from the controller "RC" to the receiver "RR" (see FIG. 2). Upon this, the control unit 100 issues at first an instruction signal to the first motor 22 to run the same to move the first operation lever 24 to the lock position inducing the lock condition of the first lock/unlock mechanism 6, and then issues an instruction signal to the second motor 23 to run the same to move the second operation lever 25 to the lock position inducing the lock condition of the second lock/unlock mechanism 14. That is, upon manipulation of the remote controller "RC", both the first and second lock/unlock mechanisms 6 and 14 are brought into the lock condition, providing a so-called "super-lock condition" of the door lock assembly.

As is described hereinabove, the door lock assembly can assume a condition wherein the first lock/unlock mechanism 6 takes the lock condition as shown in FIG. 3 and the second lock/unlock mechanism 14 takes the unlock condition as shown in FIG. 5. Under such condition of the door lock assembly, the electric actuator 20 assumes the condition as shown in FIG. 9.

When, under this condition of the door lock assembly, the inside handle of the door is manipulated, the door lock 1 permits opening of the door with the aid of the unlock condition of the second lock/unlock mechanism 14. That is, in such case, a so-called overriding operation takes place. Furthermore, upon handling of the inside handle, the first lock/unlock mechanism 6 is switched from the lock condition to the unlock condition.

That is, when the inside handle is manipulated, the switch lever 16 is pivoted in the opening direction together with the inside lever 10 bringing the pin 36 held by the projection 16*b* of the switch lever 16 into engagement with the bent part 24*f* of the first operation lever 24. With this, the first operation lever 24 is forced to move from the lock position to the unlock position, and thus the first lock/unlock mechanism 6 is switched from the lock condition to the unlock condition.

When the door lock assembly assumes the above-mentioned super-lock condition, the first lock/unlock mechanism 6 takes the lock condition as shown in FIG. 3, the second lock/unlock mechanism 14 takes the lock condition as shown in FIG. 4 and the electric actuator 20 takes a condition as shown in FIG. 2.

Under this super-lock condition of the door lock assembly, the door can not be opened even when the outside and inside handles of the door are manipulated. Thus, even if the inside handle is illegally manipulated by a person handling a picking tool or the like, the door can not be opened.

Cancellation of the super-lock condition of the door lock assembly can be made by manipulating the remote controller "RC". That is, when the remote controller "RC" is manipulated for opening the door, the control unit 100 (see FIG. 2) issues at first an instruction signal to the second motor 23 to run the same in an opposite direction to move the second operation lever 25 from the lock position to the unlock position inducing the unlock condition of the second lock/unlock mechanism 14, and then issues an instruction signal to the first motor 22 to run the same in the opposite direction to move the first operation lever 24 from the lock position to the unlock position inducing the unlock condition of the first lock/unlock mechanism 6. If desired, the remote controller "RC" may be so constructed as to independently control the first and second lock/unlock mechanisms 6 and 14. In this case, safety of the door lock assembly is much improved.

The cancellation of the super-lock condition of the door lock assembly can be made also by turning the key cylinder with the given key. That is, when the key cylinder is turned in a lock canceling direction, the second operation lever 25 is moved from the lock position to the unlock position as has been mentioned hereinabove, and thus the door can be opened. This is very advantageous in a case wherein the first and/or second electric motor 22 or 23 fails to operate due to over-discharge of a battery or the like. That is, even in such an emergency case, manipulation of the key cylinder can induce the unlock condition of the first and second lock/unlock mechanisms 6 and 14 and thus can open the door.

The entire contents of Japanese Patent Application 2000-327522 (filed Oct. 26, 2000) are incorporated herein by reference.

Although the invention has been described above with reference to the embodiment of the invention, the invention is not limited to such embodiment as described hereinabove. Various modifications and variations of such embodiment may be carried out by those skilled in the art, in light of the above descriptions.

What is claimed is:

1. An automotive door lock assembly for use with an automotive door having outside and inside handles and a key cylinder mounted thereon, comprising:

a door lock including a first lock/unlock mechanism which switches between an unlock condition wherein manipulation of said outside handle is made operative and a lock condition wherein manipulation of said outside handle is made inoperative and a second lock/unlock mechanism which switches between an unlock condition wherein manipulation of said inside handle is made operative and a lock condition wherein manipulation of said inside handle is made inoperative; and an electric actuator mounted to said door lock for actuating the same, said electric actuator including:

a housing secured to a base member of said door lock;

first and second electric motors installed in said housing;

a first operation lever straightly movably held by said housing, said first operation lever being actuated by said first electric motor to switch between an unlock position to cause said first lock/unlock mechanism to assume said unlock condition and a lock position to cause said first lock/unlock mechanism to assume said lock condition; and a second operation lever pivotally held by said housing, said second operation lever being actuated by said second electric motor to switch between an unlock position to cause said second lock/unlock mechanism to assume said unlock condition and a lock position to cause said second lock/unlock mechanism to assume said lock condition, in which said electric actuator further includes:

a first structure which moves said first operation lever to either one of the lock and unlock positions in response to manipulation of said key cylinder mounted on the door; and a second structure which is connected between the first operation lever and the second operation lever and moves said second operation lever to the unlock position when said first operation lever is moved from the lock position to the unlock position.

2. An automotive door lock assembly as claimed in claim 1, in which said electric actuator further includes:

a third structure which moves said first operation lever from the lock position to the unlock position when said second lock/unlock mechanism in the unlock condition is actuated in a given direction to open the door.

3. An automotive door lock mechanism as claimed in claim 1, in which said first structure includes:

means for sliding said first operation lever straightly relative to said housing;

a projection formed on said first operation lever;

a key lever pivotally connected to said housing, said key lever having two arms which are engageable with the projection of said first operation lever upon pivoting of said key lever; and a key connection lever integrally connected said key lever to pivot therewith, said key connection lever being linked to the key cylinder.

4. An automotive door lock assembly as claimed in claim 1, in which said second structure comprises:

a transmission lever pivotally connected to said housing, said transmission lever having at one free end a projection slidably engaged with a recess formed in said first operation lever; and a connecting bar which has one end pivotally connected to the other free end of said transmission lever and the other end which is bent and slidably engaged with an arcuate slot formed in said second operation lever.

5. An automotive door lock assembly as claimed in claim 2, in which said third structure includes:

a given part of said first operation lever; and a pin movably held said second lock/unlock mechanism of said door lock, said pin being brought into abutment with said given part to move the first operation lever to the unlock position when said second lock/unlock mechanism in the unlock condition is actuated in said given direction to open the door.

6. An automotive door mechanism as claimed in claim 3, in which said means of said first structure includes:

elongate slots formed in spaced portions of said first operation lever; and projections formed on said housing, said projections being slidably received in said elongate slots respectively.

7. An automotive door lock assembly for use with an automotive door having outside and inside handles and a key cylinder mounted thereon, comprising:

a door lock including a first lock/unlock mechanism which switches between an unlock condition wherein manipulation of said outside handle is made operative and a lock condition wherein manipulation of said outside handle is made inoperative and a second lock/unlock mechanism which switches between an unlock condition wherein manipulation of said inside handle is made operative and a lock condition wherein manipulation of said inside handle is made inoperative; and an electric actuator mounted to said door lock for actuating the same, said electric actuator including:

a housing secured to a base member of said door lock;

first and second electric motors installed in said housing;

a first operation lever straightly movably held by said housing, said first operation lever being actuated by said first electric motor to switch between an unlock position to cause said first lock/unlock mechanism to assume said unlock condition and a lock position to cause said first lock/unlock mechanism to assume said lock condition; and a second operation lever pivotally held by said housing, said second operation lever being actuated by said second electric motor to switch between an unlock position to cause said second lock/unlock mechanism to assume said unlock condition and a lock position to cause said second lock/unlock mechanism to assume said lock condition, in which said electric actuator further includes:

a rack slidably received in a groove formed in said first operation lever;

a pinion meshed with said rack; and transmission means for transmitting the power of said first electric motor to said pinion to rotate the same.

8. An automotive door lock assembly for use with an automotive door having outside and inside handles and a key cylinder mounted thereon, comprising:

a door lock including a first lock/unlock mechanism which switches between an unlock condition wherein manipulation of said outside handle is made operative and a lock condition wherein manipulation of said outside handle is made inoperative and a second lock/unlock mechanism which switches between an unlock condition wherein manipulation of said inside handle is made operative and a lock condition wherein manipulation of said inside handle is made inoperative; and an electric actuator mounted to said door lock for actuating the same, said electric actuator including:

a housing secured to a base member of said door lock;

first and second electric motors installed in said housing;

a first operation lever straightly movably held by said housing, said first operation lever being actuated by said first electric motor to switch between an unlock position to cause said first lock/unlock mechanism to assume said unlock condition and a lock position to cause said first lock/unlock mechanism to assume said lock condition; and a second operation lever pivotally held by said housing, said second operation lever being actuated by said second electric motor to switch between an unlock position to cause said second lock/unlock mechanism to assume said unlock condition and a lock position to cause said second lock/unlock mechanism to assume said lock condition, in which said electric actuator further includes:

a worm wheel driven by said second electric motor;

an arcuate toothed part formed on a free end portion of said second operation lever, said arcuate toothed part being meshed with said worm wheel;

a transmission lever pivotally moved together with said worm wheel;

first transmission means which transmits the movement of said transmission lever to said first operation lever; and second transmission means which transmits the movement of said transmission lever to said second operation lever.

9. An automotive door lock assembly as claimed in claim 8, in which said first transmission means comprises:

a projection provided on a free end of said transmission lever; and a recess formed in said first operation lever, said projection being slidably received in said recess.

10. An automotive door lock assembly as claimed in claim 9, in which said second transmission means comprises:

a connecting bar having one end pivotally connected to the other free end of said transmission lever; and an arcuate slot formed in the other free end of said second operation lever for slidably receiving the other end of said connecting bar.

* * * * *